US012479018B2

(12) United States Patent
Yamada et al.

(10) Patent No.: US 12,479,018 B2
(45) Date of Patent: Nov. 25, 2025

(54) WORKPIECE PROCESSING METHOD AND PROCESSING DEVICE

(71) Applicant: MITSUBISHI HEAVY INDUSTRIES, LTD., Tokyo (JP)

(72) Inventors: Takeshi Yamada, Tokyo (JP); Akira Kono, Tokyo (JP); Atsushi Sugai, Tokyo (JP); Yu Matsunaga, Tokyo (JP); Takeshi Hoshino, Tokyo (JP); Shota Hosoi, Tokyo (JP); Suguru Kondo, Tokyo (JP); Satoshi Kamata, Tokyo (JP)

(73) Assignee: MITSUBISHI HEAVY INDUSTRIES, LTD., Toyko (JP)

( * ) Notice: Subject to any disclaimer, the term of this patent is extended or adjusted under 35 U.S.C. 154(b) by 1232 days.

(21) Appl. No.: 16/962,725

(22) PCT Filed: Mar. 26, 2019

(86) PCT No.: PCT/JP2019/012809
§ 371 (c)(1),
(2) Date: Jul. 16, 2020

(87) PCT Pub. No.: WO2019/189149
PCT Pub. Date: Oct. 3, 2019

(65) Prior Publication Data

US 2020/0353522 A1 Nov. 12, 2020

(30) Foreign Application Priority Data

Mar. 28, 2018 (JP) ..... 2018-062005

(51) Int. Cl.
*B21D 5/08* (2006.01)
*B21D 7/08* (2006.01)
*C22F 1/04* (2006.01)

(52) U.S. Cl.
CPC ..... *B21D 5/08* (2013.01); *B21D 7/08* (2013.01); *C22F 1/04* (2013.01)

(58) Field of Classification Search
CPC ... B21D 5/06; B21D 5/08; B21D 7/08; B21D 22/022; B21D 3/12; B21D 3/14;
(Continued)

(56) References Cited

U.S. PATENT DOCUMENTS 4,410,370 A 10/1983 Baba et al.
2005/0225101 A1* 10/2005 Bladow ..... B21D 53/88 293/102

(Continued)

FOREIGN PATENT DOCUMENTS

JP S57013141 A 1/1982
JP 2004130383 A 4/2004

(Continued)

OTHER PUBLICATIONS

International Search Report and Written Opinion of International Application No. PCT/JP2019/012809 mailed Jul. 2, 2019; 6pp.

(Continued)

*Primary Examiner* — Teresa M Ekiert
(74) *Attorney, Agent, or Firm* — HAUPTMAN HAM, LLP

(57) ABSTRACT

A workpiece processing method includes: a section roll forming step of subjecting a flat plate shaped workpiece to forming to impart a prescribed cross-sectional shape thereto; a solution heat treatment step of subjecting the workpiece, after the section roll forming step has been performed, to solution heat treatment; a contour roll forming step of subjecting the workpiece, after the solution heat treatment step has been performed, to forming to bend the workpiece into an arcuate shape; and a stretch forming step of subjecting the workpiece, after the contour roll forming step has (Continued)

been performed, to forming to impart a curved shape, following a curved surface of a die, to the workpiece by bringing the workpiece into contact with the curved surface and inputting a tension load to the workpiece.

1 Claim, 4 Drawing Sheets

(58) Field of Classification Search
CPC ..... B21D 5/14; B21D 5/083; B21D 35/002; B21D 11/02; B21D 11/12
See application file for complete search history.

(56) References Cited

U.S. PATENT DOCUMENTS

| | | | | |
|---|---|---|---|---|
| 2012/0186706 | A1 | 7/2012 | Krajewski | |
| 2014/0137622 | A1* | 5/2014 | Nunome | B21D 5/08 72/201 |
| 2015/0299836 | A1 | 10/2015 | Okada et al. | |
| 2017/0066037 | A1* | 3/2017 | Kim | B21D 22/022 |
| 2017/0209957 | A1 | 7/2017 | Sato et al. | |
| 2019/0084024 | A1 | 3/2019 | Okada et al. | |

FOREIGN PATENT DOCUMENTS

| | | | |
|---|---|---|---|
| JP | 2016064426 | A | 4/2016 |
| WO | 2014097631 | A1 | 6/2014 |
| WO | 2017159806 | A1 | 9/2017 |

OTHER PUBLICATIONS

The Society of Japanese Aerospace Companies, "Result Report, Development of Low cost Fuselage Structure Part Working Process, Investigation and Research on Aircraft Parts and Raw Material Industry Promotion", No. 807, pp. 97-99, Mar. 31, 1994; 3pp.

Tadashi Minoda et al., "Industrial applications of reversion phenomenon in aluminuim allys", Light Metals, Journal of Japan Institute of Light Metals, vol. 56, No. 11, pp. 602-608, Nov. 30, 2006; 7pp.

Masujiro Hayama, "Spinning of aluminum and its alloys", Light Metals, Journal of Japan Institute of Light Metals, vol. 36, No. 12, pp. 841-850, Dec. 1986; 10pp.

Office Action for Japanese Application No. 2018062005 mailed Nov. 29, 2021; 9pp.

* cited by examiner

WORKPIECE PROCESSING METHOD AND PROCESSING DEVICE

RELATED APPLICATIONS

The present application is a National Phase of International Application Number PCT/JP2019/012809 filed Mar. 26, 2019 and claims priority to Japanese Application Number 2018-062005 filed Mar. 28, 2018.

TECHNICAL FIELD

The present invention relates to a workpiece processing method and a processing device.

BACKGROUND ART

An aircraft component such as a fuselage or a main wing of an aircraft is configured from a structural member such as a long frame. Since the fuselage, the main wing, and the like each have a curved surface shape, the frame has a curved shape bent along a longitudinal direction.

As a method of forming a frame having such a curved shape, for example, there is a method disclosed in PTL 1.

PTL 1 discloses a method in which first, solution heat treatment is performed on a plate material made of an aluminum alloy, thereby making the plate material be in a hardened state compared to that before the solution heat treatment, and the plate material subjected to the solution heat treatment is formed into a frame shape by a multi-stage roll forming device. The step of performing forming of the plate material by the multi-stage roll forming device includes a section roll step of performing forming to provide a desired cross-sectional shape to the plate material, and a carving roll step of performing forming to provide a desired contour (outline) to the plate material with the desired cross-sectional shape provided thereto.

CITATION LIST

Patent Literature

[PTL 1] International Publication No. WO 2014/097631

SUMMARY OF INVENTION

Technical Problem

In the method of PTL 1, the section roll step of providing a desired cross-sectional shape to the plate material which is in a hardened state by being subjected to the solution heat treatment is performed, and thereafter, the carving roll step of providing a desired contour (outline) is performed.

If the forming to provide a desired cross-sectional shape to the plate material is performed, a plastic strain is introduced into the plate material. Accordingly, in the method of PTL 1, the carving roll step is performed on the plate material which is in a state where the plastic strain has been introduced. Therefore, in the method of PTL 1, in the carving roll step, there is a possibility that the plate material may be broken starting from the plastic strain. Further, even in a case where the plate material is not broken in the carving roll step, the carving roll step is performed in a state where the plastic strain has been introduced, whereby there is a possibility that the plastic strain which is introduced into the plate material may increase cumulatively. In this way, for example, in a case where after the carving roll step, there is a step of further forming the plate material, in the step, the possibility of the plate material being broken starting from the plastic strain further increases.

Further, as a method of forming a workpiece having a curved shape, the following method is conceivable in addition to the method of PTL 1.

For example, a method of forming a workpiece having a curved shape by performing solution heat treatment on a workpiece subjected to a step of performing forming to provide a desired cross-sectional shape and a step of performing forming to provide a curved shape on the workpiece with the desired cross-sectional shape provided thereto, and hardening the workpiece, is also conceivable.

In order to perform the solution heat treatment, it is necessary to accommodate the workpiece in a treatment furnace. However, in the above method, since the workpiece formed to have a curved shape is subjected to the solution heat treatment, there is a possibility that the volume of a treatment furnace which is required when accommodating the workpiece may be increased. In this way, there is a possibility that the size of the treatment furnace may become large.

The present invention has been made in view of such circumstances and has an object to provide a workpiece processing method and a processing device, in which it is possible to improve the strength of a workpiece, thereby making it difficult for the workpiece to break, and to reduce the size of a treatment furnace for performing solution heat treatment.

Solution to Problem

In order to solve the above problems, a workpiece processing method and a processing device according to the present invention adopts the following means.

According to an aspect of the present invention, there is provided a workpiece processing method including: a first forming step of performing forming to impart a predetermined cross-sectional shape to a flat plate-shaped workpiece; a solution heat treatment step of performing solution heat treatment on the workpiece after the first forming step has been performed; and a second forming step of performing forming to bend the workpiece into an arcuate shape on the workpiece after the solution heat treatment step has been performed.

If the forming to impart a predetermined cross-sectional shape to the flat plate-shaped workpiece is performed, a strain generates in a deformed portion of the workpiece. In the above configuration, the solution heat treatment is performed after the first forming step of performing the forming to impart a predetermined cross-sectional shape. In this way, the strain generated in the workpiece when performing the first forming step is recovered by the solution heat treatment (heat treatment). Therefore, in the step which is performed after the solution heat treatment step, a state where the strain of the workpiece is suppressed can be achieved. Therefore, as compared with a method in which forming to impart a predetermined cross-sectional shape and forming to bend the workpiece into an arcuate shape are performed after the solution heat treatment is performed, the strength of the workpiece in the steps after the second forming step (the step of performing the forming to bend the workpiece into an arcuate shape) can be improved, and thus it is possible to make it difficult for the workpiece to break in the steps after the second forming step. In this way, the yield can be improved. Further, even when the workpiece is used it is possible to make it difficult for the workpiece to break.

Further, in order to perform the solution heat treatment, it is necessary to accommodate the workpiece in the treatment furnace. In the above configuration, the solution heat treatment is performed on the workpiece before the second forming step of bending the workpiece into an arcuate shape. In this way, the workpiece when performing the solution heat treatment is not bent into an arcuate shape. Therefore, the volume of the treatment furnace which is required when accommodating the workpiece can be reduced as compared with that in an arcuate workpiece. Therefore, the size of the treatment furnace for performing the solution heat treatment can be reduced as compared with a case where the solution heat treatment is performed after the workpiece is bent into an arcuate shape.

As the workpiece, an aluminum alloy can be given as an example.

Further, the workpiece processing method according to the aspect of the present invention may further include a third forming step of performing, on the workpiece after the second forming step has been performed, forming to impart a curved shape along a curved surface of a die having the curved surface to the workpiece by bringing the workpiece into contact with the curved surface of the die and inputting a tensile load in a tangential direction to the curved surface to the workpiece.

In the above configuration, since the processing of bending the workpiece is performed using the die, the workpiece can be bent with high accuracy.

Further, even in a case where a tensile load is applied to the workpiece, since the strain in the first forming step has been eliminated, the breakage of the workpiece can be suppressed.

Further, there is a case where a twist or the like occurs in the workpiece when the solution heat treatment is performed. In the above configuration, the forming to bend the workpiece into an arcuate shape (the second forming step) is performed after the solution heat treatment is performed. In this way, even in a case where a twist or the like occurs in the workpiece when the solution heat treatment is performed, the forming to bend the workpiece into an arcuate shape is performed on the workpiece, whereby it is possible to eliminate the twist or the like. Therefore, when performing the third forming step, the workpiece can be easily mounted on the device. Therefore, the third forming step can be facilitated.

According to an aspect of the present invention, there is provided a processing device for performing forming to impart a predetermined cross-sectional shape to a flat plate-shaped workpiece and then bending the workpiece subjected to solution heat treatment into an arcuate shape, the device including: a plurality of supporting parts that support the workpiece so as to be transferable in a predetermined direction by gripping the workpiece between a pair of rollers disposed to face each other such that rotation axes thereof are parallel to each other, in which the plurality of supporting parts are disposed side by side in the predetermined direction, and in a state where the plurality of supporting parts support the workpiece, at least one of the supporting parts supporting the workpiece moves in an intersecting direction that is a direction intersecting the predetermined direction to bend the workpiece into an arcuate shape.

When bending the workpiece, if the supporting part moves in a state where it does not support the workpiece, there is a possibility that the workpiece may be damaged due to the collision between the transferred workpiece and the supporting part.

In the above configuration, in a state where the supporting part supports the workpiece, the supporting part moves in the intersecting direction. In other words, after the pair of rollers of the supporting part grips the workpiece, the supporting part moves in the intersecting direction. In this manner, since the supporting part moves in a state where it reliably supports the workpiece, it is possible to prevent the workpiece from being damaged due to moving in a state where the supporting part does not support the workpiece.

Further, in the processing device according to the aspect of the present invention, each of the plurality of supporting parts may include a drive unit that rotates the roller around the rotation axis, and change a rotation speed of each drive unit.

The workpiece after the solution heat treatment has been performed is in a state where hardness is increased, and is formed such that a length in the longitudinal direction is relatively short, and therefore, it is difficult to grip the workpiece by the rollers.

In the above configuration, each of the plurality of supporting parts has the drive unit that rotationally drives the rollers. In this way, the driving force for transferring the workpiece can be increased. Therefore, even the workpiece after the solution heat treatment has been performed can be reliably gripped by the rollers and transferred in a predetermined direction by the rotational driving forces of the rollers.

Further, in the above configuration, the rotation speed of each drive unit provided at each supporting part is changed. In this way, the workpiece can be formed by changing the bending radius of curvature thereof. For example, the rotation speed is increased as it goes toward the drive unit disposed on the outlet side, whereby it is possible to make the bending radius of curvature of the workpiece large. Further, the rotation speed is reduced as it goes toward the drive unit disposed on the outlet side, whereby it is possible to make the bending radius of curvature of the workpiece small.

Advantageous Effects of Invention

According to the present invention, it is possible to improve the strength of the workpiece, thereby making it difficult for a workpiece to break, and it is possible to reduce the size of a treatment furnace for performing solution heat treatment.

DESCRIPTION OF EMBODIMENTS

Hereinafter, an embodiment of a workpiece processing method and a processing device according to the present invention will be described with reference to the drawings.

The processing method according to the present embodiment performs processing of imparting a predetermined cross-sectional shape to a plate-shaped work (workpiece) W made of an aluminum alloy, and performs processing of bending the work W with a predetermined cross-sectional shape imparted thereto such that a longitudinal direction thereof forms an arc. The processed work W is used, for example, for a frame or the like configuring an aircraft component such as a fuselage or a main wing of an aircraft. That is, the processing method according to the present embodiment is used when manufacturing a frame or the like configuring an aircraft component such as a fuselage or a main wing of an aircraft from the plate-shaped work W.

The processing method according to the present embodiment will be described with reference to FIGS. 1A to 1E. FIGS. 1A to 1E show the processing method.

As shown in FIG. 1A to FIG. 1E, the processing method of the present embodiment includes a section roll forming step (first forming step) of performing forming to impart a predetermined cross-sectional shape to a flat plate-shaped work W, a solution heat treatment step of performing solution heat treatment on the work W after the section roll forming step has been performed, a contour roll forming step (second forming step) of performing forming to bend the work W into an arcuate shape on the work W after the solution heat treatment step has been performed, and a stretch forming step (third forming step) of enhancing processing accuracy by imparting a curved shape to the work W after the contour roll forming step has been performed by bringing the work W into contact with a die 12 while pulling both ends.

Figure 1A:
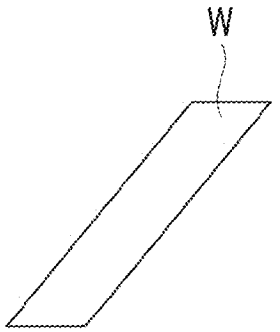
FIGS. 1A-E are diagrams showing a flow of a work processing method according to an embodiment of the present invention.
Figure 1B:
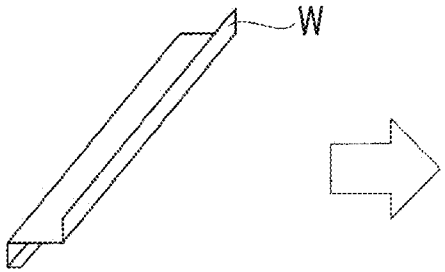
Figure 2:
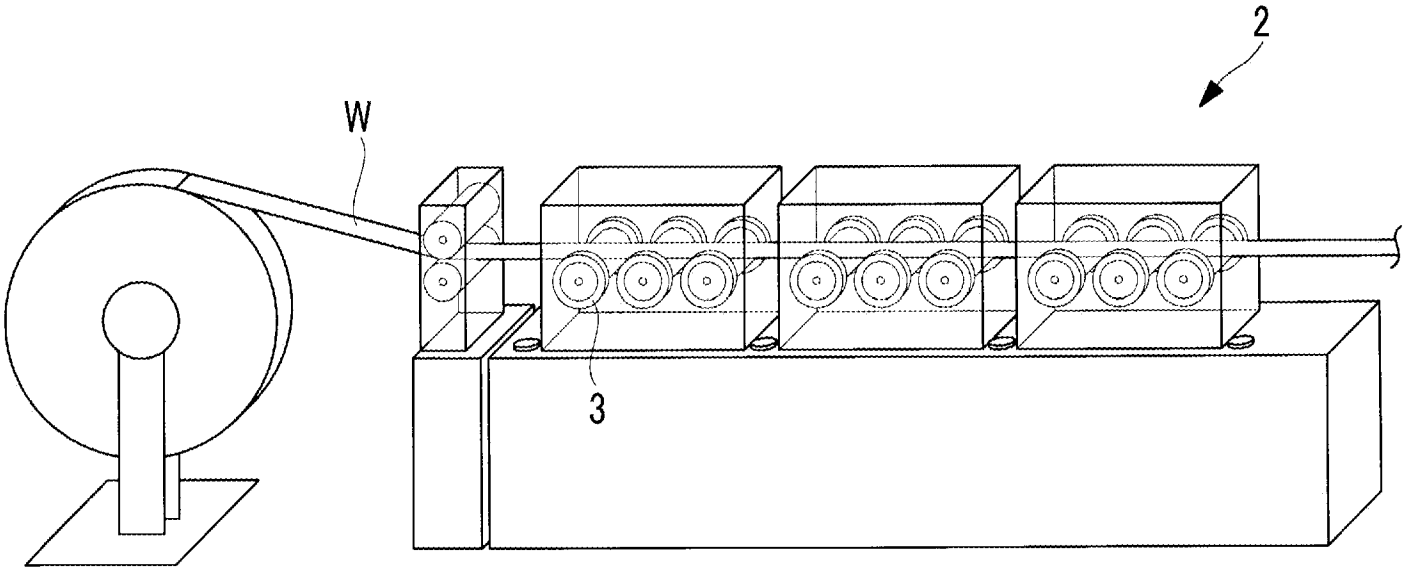
FIG. 2 is a schematic perspective view of a section roll forming device according to an embodiment of the present invention.

The section roll forming step is performed by a section roll forming device 2 shown in FIG. 2. In the section roll forming step, forming to impart a predetermined cross-sectional shape to the work W by introducing a flat plate-shaped work W connected into a band shape between plural sets of forming rolls 3 provided in the section roll forming device 2 is performed. The work W with a predetermined cross-sectional shape imparted thereto is taken out from the section roll forming device 2 and cut to have a predetermined length, whereby a long work W with a predetermined cross-sectional shape imparted thereto is obtained. In the present embodiment, as an example, the long work W shown in FIG. 1B is formed by performing forming to impart a substantially Z-shaped cross-sectional shape to the work W and cutting the work W with a cross-sectional shape imparted thereto into a length in a range of 5 m to 6 m.

The work W to be subjected to the section roll forming is an annealed material (so-called O material).

Figure 1C:
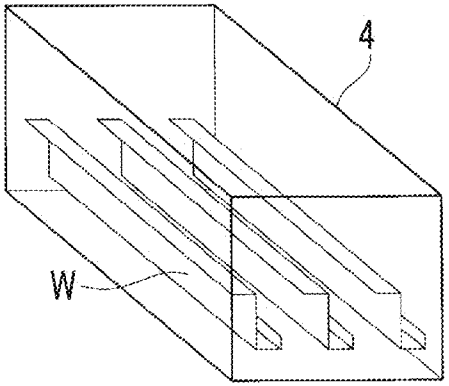
Figure 1D:
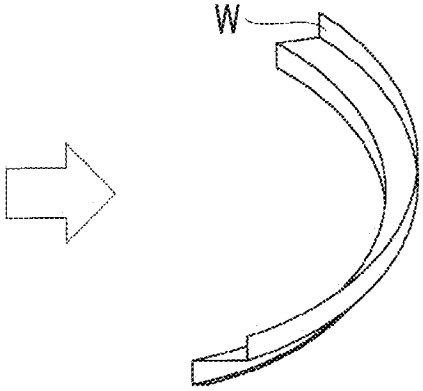

In the solution heat treatment step, as shown in FIG. 1C, the long work W formed by the section roll forming step is accommodated in a treatment furnace 4. Then, solution heat treatment is performed on the work W accommodated in the treatment furnace 4.

Figure 3:
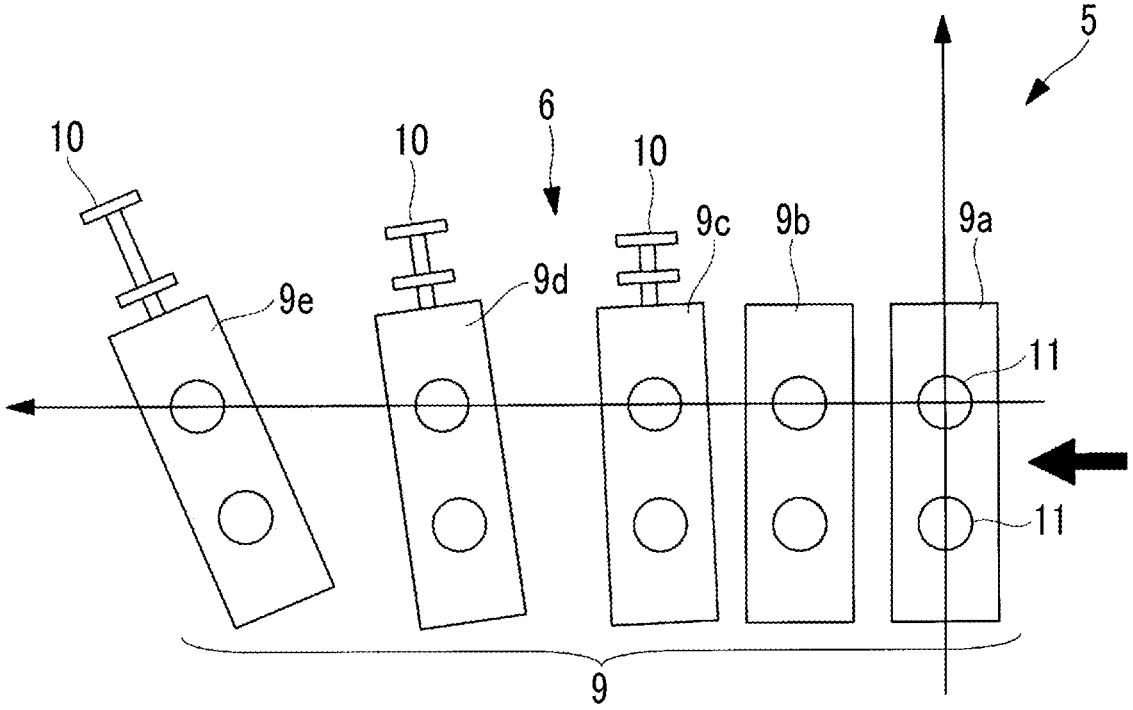
FIG. 3 is a schematic top view of a contour roll forming device according to an embodiment of the present invention.
Figure 4:
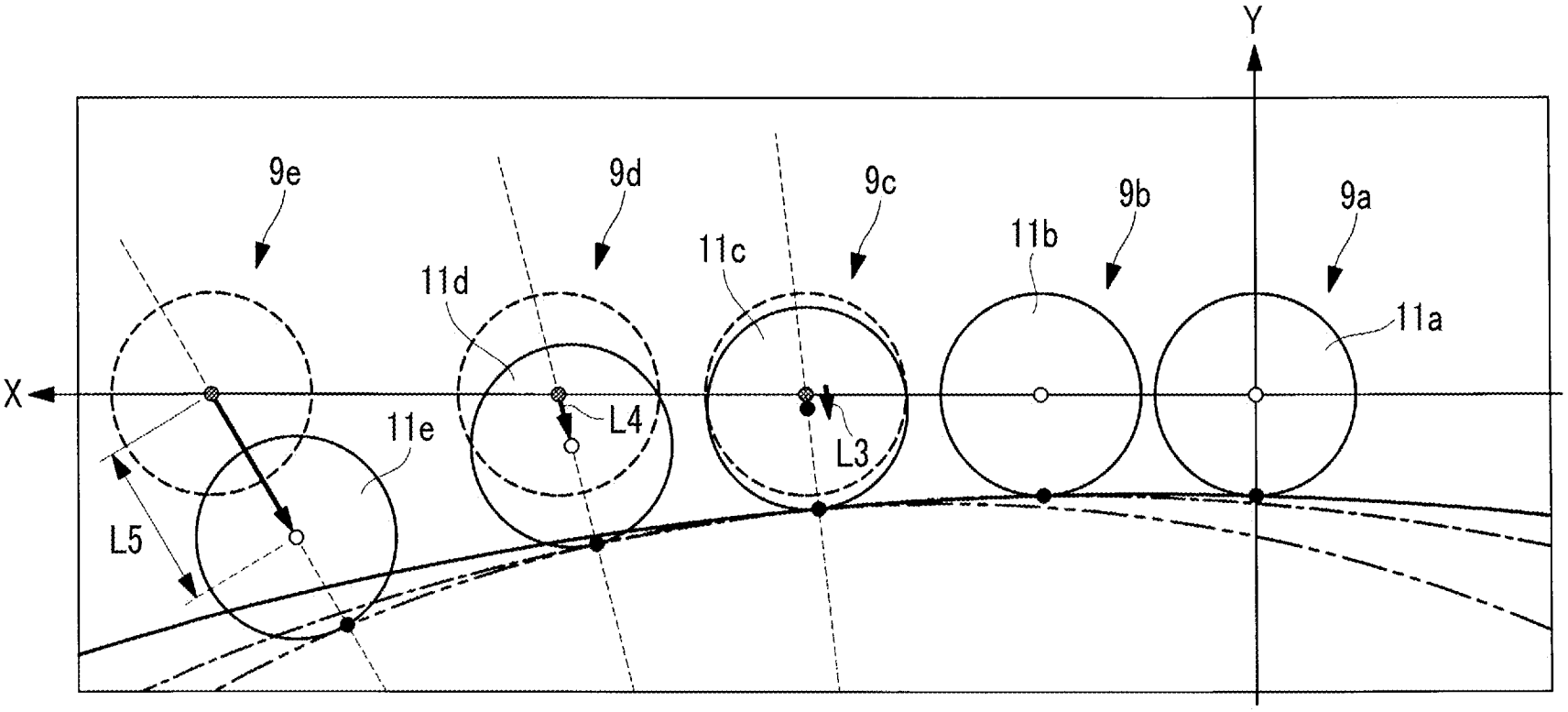
FIG. 4 is a diagram schematically showing a main part of the contour roll forming device of FIG. 3.

The contour roll forming step is performed by a contour roll forming device (a processing device) 5 shown in FIGS. 3 and 4. The contour roll forming step is performed on the work W that is the work W after the solution heat treatment has been performed and is a material (so-called W material) before natural aging. In this manner, in the present embodiment, the temper of the work W to be subjected to the contour roll forming step is different from the temper of the work W to be subjected to the section roll forming step.

The contour roll forming device 5 includes a main body part 6 in which bending forming is performed while transferring the long work W in a predetermined direction, a first pinch roll (not shown) for introducing the work W into the main body part 6, a second pinch roll (not shown) for taking out the work W from the main body part 6, and a control device (not shown) for controlling the main body part 6, and performs forming in which the introduced work W is transferred in a predetermined direction and bent into an arcuate shape such that the longitudinal direction thereof describes an arc. The black arrow in FIG. 3 indicates the direction in which the work is introduced.

The main body part 6 includes five supporting parts 9 which are disposed side by side in the transfer direction of the work W (the predetermined direction), and a moving part 10 that moves a specific supporting part 9 in an intersecting direction that is a direction intersecting the transfer direction.

Each of the supporting parts 9 has a pair of (two) rollers 11 disposed to face each other such that rotation axes extending in an up-down direction are parallel to each other, and grips the long work W between the pair of rollers 11 to support the long work W so as to be able to be transferred in a predetermined direction. Further, a servomotor (drive unit) (not shown) that rotationally drives the roller 11 around the rotation axis is directly connected to each roller 11 provided in each supporting part. That is, the servomotors are directly connected to all of the ten rollers 11 of the main body part 6.

Each supporting part 9 transfers the introduced work W to the adjacent supporting part 9 on the downstream side in the transfer direction of the work W by the rotational driving forces of the rollers 11.

The five supporting parts 9 are disposed side by side in the transfer direction of the work W, as described above. In the following description, a first supporting part 9*a*, a second supporting part 9*b*, a third supporting part 9*c* a fourth supporting part 9*d*, and a fifth supporting part 9*e* are arranged in this order from the supporting part 9 disposed on the first pinch roll side (that is, on the upstream side in the transfer direction of the work W). Further, the third supporting part 9*c*, the fourth supporting part 9*d*, and the fifth supporting part 9*e* are disposed so as to be inclined by a predetermined angle with respect to the first supporting part 9*a* and the second supporting part 9*b*. Further, each supporting part 9 is disposed such that the inclination angle of the third supporting part 9*c*, the inclination angle of the fourth supporting part 9*d*, and the inclination angle of the fifth supporting part 9*e* are different from each other. That is, the third supporting part 9*c*, the fourth supporting part 9*d*, and the fifth supporting part 9*e* are not disposed in parallel. The disposition of each supporting part 9 is set in accordance with the bend aspect (curvature or the like) of the work W after forming.

The three moving parts 10 are provided so as to correspond to the third supporting part 9*c*, the fourth supporting part 9*d*, and the fifth supporting part 9*e*. That is, in the present embodiment, the third supporting part 9*c*, the fourth supporting part 9*d*, and the fifth supporting part 9*e* among the five supporting parts 9 provided in the main body part 6 are movable at the time of the processing of the work W, and the first supporting part 9*a* and the second supporting part 9*b* are configured not to move at the time of the processing of the work W.

The moving part 10 linearly moves the supporting part 9 in the intersecting direction by the driving force of a driving source (not shown). The moving directions of the third supporting part 9*c*, the fourth supporting part 9*d*, and the fifth supporting part 9*e* are not parallel. The moving direction of each supporting part 9 is set in accordance with the bend aspect (curvature or the like) of the work W after forming.

Further, as shown in FIG. 4, the movement distance of each supporting part 9 increases as it goes toward the supporting part 9 disposed on the downstream side. That is, when the movement distance of the third supporting part 9*c* is set to be L3, the movement distance of the fourth supporting part 9*d* is set to be L4, and the movement distance of the fifth supporting part 9*e* is set to be L5, the relationship between the movement distances is L3<L4<L5.

The control device controls each moving part 10, based on information which is sent from a determination unit (not shown) that determines whether or not each supporting part has supported the work W. Specifically, after the determination unit determines that the supporting part 9 has supported the work W, the control device moves the moving part 10 corresponding to the supporting part 9.

As the determination unit, motor rotation speed measurement means for measuring the rotation speed provided in the servomotor can be given as an example, and the control device may determine that the rollers 11 have supported the work W, in a case where the rotation speed of the servomotor measured by the motor rotation speed measurement means is reduced. The motor rotation speed measurement means is an example of the determination unit, and the present invention is not limited to this. The determination unit may be any device as long as it can determine whether or not the supporting part 9 has supported the work W.

The control device includes, for example, a CPU (Central Processing Unit), a RAM (Random Access Memory), a ROM (Read Only Memory), a computer-readable storage medium, and the like. Then, a series of processes for realizing various functions are stored in the storage medium or the like in the form of a program as an example, and the CPU reads the program into the RAM or the like and executes information processing and arithmetic processing, whereby various functions are realized. As the program, a form installed in advance in a ROM or other storage medium, a form which is provided in a state of being stored in a computer-readable storage medium, a form which is distributed through wired or wireless communication means, or the like may be applied. The computer-readable storage medium is a magnetic disk, a magneto-optical disk, a CD-ROM, a DVD-ROM, a semiconductor memory, or the like.

The first pinch roll is disposed on the upstream side of the first supporting part 9*a*. The first pinch roll assists in the introduction of the work W into the first supporting part 9*a*. The second pinch roll is disposed the downstream side of the fifth supporting part 9*e*. The second pinch roll assists in the pulling-out of the work W from the fifth supporting part 9*e*.

The contour roll forming device 5 according to the present embodiment is configured in this manner. That is, in the contour roll forming device 5, in a state where the plurality of supporting parts 9 support the introduced work W, at least one of the supporting parts 9 supporting the work W moves in the intersecting direction, thereby bending the work W into an arcuate shape.

Specifically, describing the operation of the contour roll forming device 5 with reference to FIG. 4, first, a tip portion of the work W introduced into the contour roll forming device 5 is gripped by rollers 11*a* of the first supporting part 9*a* under the assist of the first pinch roll. The tip portion of the work W gripped by the rollers 11*a* of the first supporting part 9*a* is transferred to the second supporting part 9*b* by the rotational driving forces of the rollers 11*a*. At this time, the portion other than the tip portion of the work W is still in a state of being gripped by the first supporting part 9*a*.

The tip portion of the work W transferred to the second supporting part 9*b* is gripped by rollers 11*b* of the second supporting part 9*b* and is transferred to the third supporting part 9*c* by the driving forces of the rollers 11*b*. If the tip portion of the work W is transferred to the third supporting part 9*c*, rollers 11*c* of the third supporting part 9*c* grip the tip portion of the work W. At this time, a substantially central portion in the longitudinal direction of the work W is still in a state of being gripped by the second supporting part 9*b*, and a downstream end portion of the work W is still in a state of being gripped by the first supporting part 9*a*. That is, the work W is in a state of being supported by the three supporting parts 9: the first supporting part 9*a*, the second supporting part 9*b*, and the third supporting part 9*c*.

If the determination unit determines that the third supporting part 9*c* has gripped the tip portion of the work W, the control device transmits a signal to the moving part 10 corresponding to the third supporting part 9*c* to drive the moving part 10, thereby moving the third supporting part 9*c*. That is, the rollers 11*c* of the third supporting part 9*c* move by a predetermined distance L3 from the initial position indicated by a broken line circle to the position indicated by a solid line circle. At this time, since the first supporting part 9*a* and the second supporting part 9*b* do not move, if the third supporting part 9*c* moves, the work W is bent according to the movement of the third supporting part 9*c*. Specifically, the work W is bent into an arc shape connecting the respective end portions of the roller 11*a*, the roller lib, and the moved roller 11*c*, as shown by a solid line arc in FIG. 4.

The third supporting part 9*c* moves and also transfers the tip portion of the work W to the fourth supporting part 9*d* by the driving forces of the rollers 11*c*. If the tip portion of the work W is transferred to the fourth supporting part 9*d*, rollers 11*d* of the fourth supporting part 9*d* grip the tip portion of the work W. At this time, the downstream end portion of the work W is released from being gripped by the first supporting part 9*a* and is gripped by the second supporting part 9*b*. That is, the work W is in a state of being supported by the three supporting parts 9: the second supporting part 9*b*, the third supporting part 9*c*, and the fourth supporting part 9*d*.

If the determination unit determines that the fourth supporting part 9*d* has gripped the tip portion of the work W, the control device transmits a signal to the moving part 10 corresponding to the fourth supporting part 9*d* to drive the moving part 10, thereby moving the fourth supporting part 9*d*. That is, the rollers 11*d* of the fourth supporting part 9*d* move by a predetermined distance L4 from the initial position indicated by the broken line circle to the position indicated by the solid line circle. If the fourth supporting part 9*d* moves, the work W is bent according to the movement of the fourth supporting part 9*d*. Specifically, the work W is bent into an arc shape connecting the respective end portions of the roller lib, the moved roller 11*c*, and the moved roller 11*d*, as shown by a dashed-dotted line arc in FIG. 4.

The fourth supporting part 9*d* moves and also transfers the tip portion of the work W to the fifth supporting part 9*e* by the driving forces of the rollers 11*d*. If the tip portion of the work W is transferred to the fifth supporting part 9*e*, rollers 11*e* of the fifth supporting part 9*e* grip the tip portion of the work W. At this time, the downstream end portion of the work W is released from being gripped by the second supporting part 9*b* and is gripped by the third supporting part 9*c*. That is, the work W is in a state of being supported by the three supporting parts 9: the third supporting part 9*c*, the fourth supporting part 9*d*, and the fifth supporting part 9*e*.

If the determination unit determines that the fifth supporting part 9*e* has gripped the tip portion of the work W, the control device transmits a signal to the moving part 10 corresponding to the fifth supporting part 9*e* to drive the moving part 10, thereby moving the fifth supporting part 9*e*. That is, the rollers 11*e* of the fifth supporting part 9*e* move by a predetermined distance L5 from the initial position indicated by the broken line circle to the position indicated by the solid line circle. If the fifth supporting part 9*e* moves, the work W is bent according to the movement of the fifth supporting part 9*e*. Specifically, the work W is bent into an arc shape connecting the respective end portions of the moved roller 11*c*, the moved roller 11*d*, and the moved roller 11*e*, as shown by a two-dot chain line arc in FIG. 4.

The fifth supporting part 9*e* moves and also discharges the work W by the driving forces of the rollers 11*e*. At this time, the second pinch roll assists in the discharge of the work W.

In this way, the forming by the contour roll forming device 5 is performed.

Figure 1E:
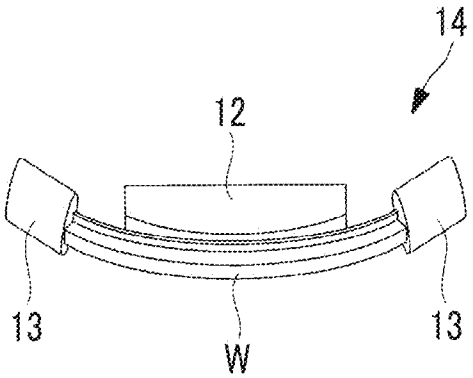

The stretch forming step is performed by a stretch forming device 14, as shown in FIG. 1E. In the stretch forming step, plastic deformation is performed on the work W bent into an arcuate shape by the forming in the contour roll forming step, thereby further imparting a curved shape to the work W.

Specifically, in the stretch forming step, a curved shape along the curved surface of the die 12 having a curved shape is imparted to the work W by bringing the work W into contact with the curved surface of the die 12, and pulling the work W by gripping devices 13 that grip both ends of the work W, thereby inputting a tensile load in a tangential direction to the curved surface to the work W. At this time, since the curved surface of the die 12 has a curved shape which is required for a product or a shape close to the curved shape, highly accurate processing can be performed by performing the stretch forming.

In this manner, in the processing method according to the present embodiment, after the section roll forming is performed on the work W that is an O material, the solution heat treatment is performed, and the contour roll forming and the stretch forming are performed on the work W that has been subjected to the solution heat treatment to become a W material, whereby the work W is processed into a bent work W with a predetermined cross-sectional shape imparted thereto. In the present embodiment, since the contour roll forming and the stretch forming are performed on the work W that is the W material, the contour roll forming and the stretch forming are performed before the work W which has been subjected to the solution heat treatment is naturally aged.

The work W that is the W material may be temporarily stored in a freezer maintained at a temperature equal to or less that a predetermined temperature, between the solution heat treatment step and the contour roll forming step or between the contour roll forming step and the stretch forming step. By storing the work W in the freezer, the state of the W material can be maintained for a long time without the natural aging of the work W progressing.

According to the present embodiment, the following operation and effects can be obtained.

If the forming (section roll forming) to impart a predetermined cross-sectional shape to the flat plate-shaped work W is performed, a strain generates in the work W (particularly, a deformed portion of the work W). In the present embodiment, the solution heat treatment is performed after the section roll forming step of performing the forming to impart a predetermined cross-sectional shape is performed. In this way, the strain generated in the work W when performing the section roll forming step is recovered by the solution heat treatment (heat treatment). Therefore, in the contour roll forming step and the stretch forming step which are performed after the solution heat treatment step, it is possible to create a state where the strain of the work W is suppressed. Therefore, as compared with a method in which the section roll forming, the contour roll forming, and the stretch forming are performed after the solution heat treatment is performed, the strength of the work W in the section roll forming step and the stretch forming step is improved, and thus it is possible to make it difficult for the work W to break in the section roll forming step and the stretch forming step. Further, it is possible to make it difficult for the work W to break even when the work W is used as a product.

In particular, in a case where the section roll forming, the contour roll forming, and the stretch forming are performed after the solution heat treatment is performed, the strain generated when the section roll forming is performed is cumulatively accumulated in the subsequent forming step, and therefore, a risk of breakage particularly increases in the stretch forming step. In particular, since a locally input load increases in the portion gripped by the gripping device 13, the risk of breakage increases.

In the present embodiment, as described above, since the strain generated in the work W when the section roll forming step is performed is recovered by the solution heat treatment (heat treatment), it is possible to make it difficult for the work W to break even in the stretch forming step. Therefore, the stretch forming is performed on the work W, whereby the processing accuracy can be improved and the risk of breakage can also be reduced.

In this manner, the yield can be improved by making it difficult for the work W to break. In a case where the possibility of the work W breaking can be reduced as much as possible, it is possible to eliminate the need to set the yield. Further, it is possible to prevent a situation in which normal production stops due to a recovery operation from the breakage of the work W.

Further, there is a case where a twist or the like occurs in the work W when the solution heat treatment is performed. In the present embodiment, the contour roll forming is performed after the solution heat treatment is performed. In this way, even in a case where a twist or the like occurs in the work W when the solution heat treatment is performed, the twist or the like can be eliminated by performing the contour roll forming on the work W. Therefore, when the stretch forming step is performed, the work W can be easily mounted on the stretch forming device 14. Therefore, the stretch forming step can be facilitated.

Further, in order to perform the solution heat treatment, it is necessary to accommodate the work W in the treatment furnace 4. In the present embodiment, the solution heat treatment is performed on the work W before the contour roll forming step of bending the work W into an arcuate shape is performed. In this way, the work W when performing the solution heat treatment has a straight line shape that is not bent in an arcuate shape. Therefore, the volume of the treatment furnace 4 which is required for accommodating the work W can be made smaller than that in an arcuate work W. Therefore, the size of the treatment furnace 4 for performing the solution heat treatment can be reduced as compared with a case where the solution heat treatment is performed after the work W is bent into an arcuate shape.

Further, when the work W is bent by the contour roll forming device 5, if the supporting part 9 moves in a state where it does not support the work W, the transferred work W collides with the supporting part 9, whereby there is a possibility that the work W may be damaged.

In the contour roll forming device 5 of the present embodiment, the supporting part 9 moves in the intersecting direction in a state where the supporting part 9 supports the work W. In other words, after the pair of rollers 11 of the supporting part 9 grips the work W, the supporting part 9 moves in the intersecting direction. In this manner, since the supporting part 9 moves in a state it reliably supports the work W, it is possible to prevent the work W from being damaged due to moving in a state where it does not support the work W.

Further, the work W after the solution heat treatment has been performed is in a state where the hardness is increased, and is formed such that the length in the longitudinal direction is relatively short, and therefore, the work W is difficult to be gripped by the rollers 11.

In the present embodiment, the servomotors are directly connected to all the rollers 11. In this way, the driving force for transferring the work W can be increased. Therefore, even the work W after the solution heat treatment has been performed can be reliably gripped by the rollers 11 and can be transferred in a predetermined direction by the rotational driving forces of the rollers 11.

By utilizing this, it is also possible to form the work W by changing the bending radius of curvature of the work W by changing the rotation speed of the rollers 11 at each stage. If the rotation speed increases toward the outlet, the bending radius of curvature becomes slightly larger, and conversely, if the speed is reduced, it is also possible to make the bending radius of curvature slightly smaller.

Further, in the present embodiment, the first pinch roll and the second pinch roll assisting in the introduction and taking-out of the work W into and from the contour roll forming device 5 are provided. In this way, the work W can be more reliably introduced into the contour roll forming device 5 and the work W can be more reliably taken out from the contour roll forming device 5.

The present invention is not limited to the invention according to the embodiment described above and can be appropriately modified within a scope which does not depart from the gist of the invention.

For example, in the embodiment described above, the example in which the servomotors are directly connected to all the rollers 11 included in the main body part 6 has been described. However, the present invention is not limited to this. A servomotor may be provided only at a specific roller 11. Further, instead of directly connecting the roller 11 and the servomotor, the roller 11 and the servomotor may be indirectly connected through a gear or the like.

Further, in the present embodiment, the example in which the five supporting parts 9 are provided has been described. However, the present invention is not limited to this. The number of the supporting parts 9 may be less than or more than five as long as it is the plural.

The invention claimed is:

1. A workpiece processing method comprising:

a first forming step of performing forming to impart a predetermined cross-sectional shape to a flat plate-shaped workpiece and obtaining a long workpiece;

a solution heat treatment step of performing solution heat treatment on the long workpiece after the first forming step has been performed;

a second forming step of performing forming to bend the long workpiece into an arcuate shape such that a longitudinal direction of the long workpiece describes an arc on the long workpiece after the solution heat treatment step has been performed; and a third forming step of performing, on the long workpiece after the second forming step has been performed, forming to impart a curved shape to the long workpiece by bringing the long workpiece into contact with a curved surface of a die, and pulling the long workpiece by gripping both ends of the long workpiece, thereby inputting a tensile load in a tangential direction to the curved surface of the die to the long workpiece.

* * * * *